US008409027B1

(12) United States Patent
Gagnon

(10) Patent No.: US 8,409,027 B1
(45) Date of Patent: Apr. 2, 2013

(54) METHOD FOR A PLAYER TO PLAY GOLF AND SYSTEM THEREFOR

(76) Inventor: Carl R. Gagnon, Castro Valley, CA (US)

( * ) Notice: Subject to any disclaimer, the term of this patent is extended or adjusted under 35 U.S.C. 154(b) by 165 days.

(21) Appl. No.: 12/804,219

(22) Filed: Jul. 17, 2010

(51) Int. Cl.
*A63B 69/36* (2006.01)

(52) U.S. Cl. ..... 473/278; 473/405

(58) Field of Classification Search ..... 473/266–268, 473/278, 405
See application file for complete search history.

(56) References Cited

U.S. PATENT DOCUMENTS

| | | | | | |
|---|---|---|---|---|---|
| 1,596,110 | A * | 8/1926 | Lynch | 473/218 |
| 3,542,369 | A * | 11/1970 | Anderson | 473/257 |
| 3,561,764 | A * | 2/1971 | Thomas | 473/257 |
| 3,992,011 | A * | 11/1976 | Jessee | 473/268 |
| 5,067,719 | A * | 11/1991 | Mook | 473/200 |
| 5,645,494 | A * | 7/1997 | Dionne et al. | 473/278 |
| 6,569,026 | B1 * | 5/2003 | Weis | 473/139 |
| 6,769,999 | B1 * | 8/2004 | Chase | 473/386 |
| 7,131,910 | B2 * | 11/2006 | Townsend, II | 473/278 |
| 7,527,562 | B1 * | 5/2009 | Mason | 473/257 |
| 2003/0130055 | A1 * | 7/2003 | Townsend, II | 473/278 |
| 2003/0190972 | A1 * | 10/2003 | Townsend, II | 473/278 |
| 2005/0250592 | A1 * | 11/2005 | Roach | 473/268 |
| 2010/0130299 | A1 * | 5/2010 | Womersley et al. | 473/268 |

OTHER PUBLICATIONS

Website www.afterimagetech.com/home put Online Jul. 2007 (See Attached 14 Pages).

* cited by examiner

*Primary Examiner* — Raleigh W. Chiu
(74) *Attorney, Agent, or Firm* — Ted Masters

(57) ABSTRACT

A system and method for a player to play golf includes a member having a surface. A colored area is disposed on the surface of the member, the colored area is yellow which when stared at will produce a violet afterimage. Prior to hitting a golf ball, the player stares at the colored area for a few seconds, closes his/her eyes and sees the violet afterimage, then opens his/her eyes. The player then hits the golf ball.

8 Claims, 10 Drawing Sheets

METHOD FOR A PLAYER TO PLAY GOLF AND SYSTEM THEREFOR

CROSS REFERENCE TO RELATED APPLICATION

None

TECHNICAL FIELD

The present invention pertains generally to the game of golf, and more particularly to a method and system for improving a player's golf game.

BACKGROUND OF THE INVENTION

Visual afterimages are well known in the art. If a person stares at a first color (red for example) for a period of time, and then looks at a second surface (e.g. white), an afterimage of the complementary color (in this case cyan) of the first color will appear. Research in neurophsychology has shown that viewing afterimages can slow down brain waves, resulting in numerous positive health benefits. Additional research has shown that by staring at a yellow color, a violet afterimage will be produced. When the yellow color is viewed for a few minutes a day, over a period of 3 to 4 weeks, it caused the viewer to produce alpha brain waves. Alpha brain waves (3 Hz-12 Hz) are much slower than normal waking 'beta' brain waves, and create a feeling of well-being and increased focus. These brain wave functions characterize optimal performance or what is sometimes referred to as being in "The Zone." The state produced by alpha brain waves is characterized by extreme relaxation and blissful pleasure, reduced stress, a slowing of physiological functions, sharpened focus, flowing movement and spontaneity. It has further been found that alpha brain waves, reduce pain, depression, stress and blood pressure, and results in other positive health results.

BRIEF SUMMARY OF THE INVENTION

The present invention is directed to a method and system which applies the afterimage principle to the game of golf. The method and system quiets the player's mind, and enables the player to significantly improve his/her performance. It does so by providing levels of mental relaxation that otherwise can only be achieved by years of training, practice, and experience. The present invention enables the player to slow down his/her brain waves enabling them to reach "The Zone" and improve their overall golf game.

The method and system include a member (typically a white sheet) which has a yellow colored area which will produce a violet afterimage. In one embodiment the member is placed on the ground adjacent to a golf ball and stared at by the player before the golf ball is hit. In another embodiment the member has a hole which receives a golf tee upon which a golf ball is placed. And in a third embodiment, the member is attached to the top of the shoe or other article of wearing apparel of the golfer.

In accordance with a preferred embodiment, a method for a player to play golf includes:

(a) providing a support surface;

(b) providing a golf club;

(c) providing a system for playing golf including;

a member having a surface;

a colored area disposed on the surface of the member, the colored area being yellow;

a golf ball which is positionable upon the support surface;

(d) placing the golf ball and the member upon the support surface so that the player can view both the golf ball and the colored area;

(e) the player staring at the colored area for a few seconds;

(f) after step (e), the player closing his or her eyes and seeing a violet afterimage; and, (g) the player opening his or her eyes and using the golf club to hit the golf ball.

The method further including:

in step (c), a second area disposed on the surface of the member, providing a golf tee having a shank;

in step (c), a hole disposed in the second area, said hole shaped and dimensioned to receive the shank of the golf tee; and, in step (d), the player placing the shank of the golf tee through the hole in the member, and inserting the shank into the support surface.

The method further including:

in step (c) the member being disk shaped.

The method further including:

in step (c), said yellow having a wavelength of about 550 nanometers; and, in step (f), said violet afterimage having a wavelength of about 400 nanometers.

The method further including:

in step (c), the colored area being a fluorescent yellow.

The method further including:

prior to step (f), the player conditioning his/her vision by staring at the colored area for a short period of time every day for a few weeks.

In accordance with another embodiment, a method for a player to play golf includes:

(a) providing a support surface;

(b) providing a golf club;

(c) providing a system for playing golf including;

a member having a surface;

a colored area disposed on said surface of said member, said colored area being yellow;

a golf ball which is positionable upon the support surface;

an article of wearing apparel worn by the player;

(d) causing the member to be disposed on the article of wearing apparel so that the colored area is visible to the player;

(e) placing the golf ball upon the support surface;

(f) the player staring at the colored area for a few seconds;

(g) after step (f), the player closing his or her eyes and seeing a violet afterimage; and, (h) the player opening his or her eyes and using the golf club to hit the golf ball.

The method further including:

in step (c), providing a connector for connecting the member to the wearing apparel in step (d).

The method further including:

in step (c), the article of wearing apparel being a shoe having a vamp; and, in step (d), connecting the member to the vamp of the shoe so that the colored area can be viewed by the player.

Other possible embodiments, in addition to the possible embodiments enumerated above, will become apparent from the following detailed description, taken in conjunction with the accompanying drawings, which illustrate, by way of example, the principles of the method and system.

DETAILED DESCRIPTION OF THE INVENTION

Figure 1:
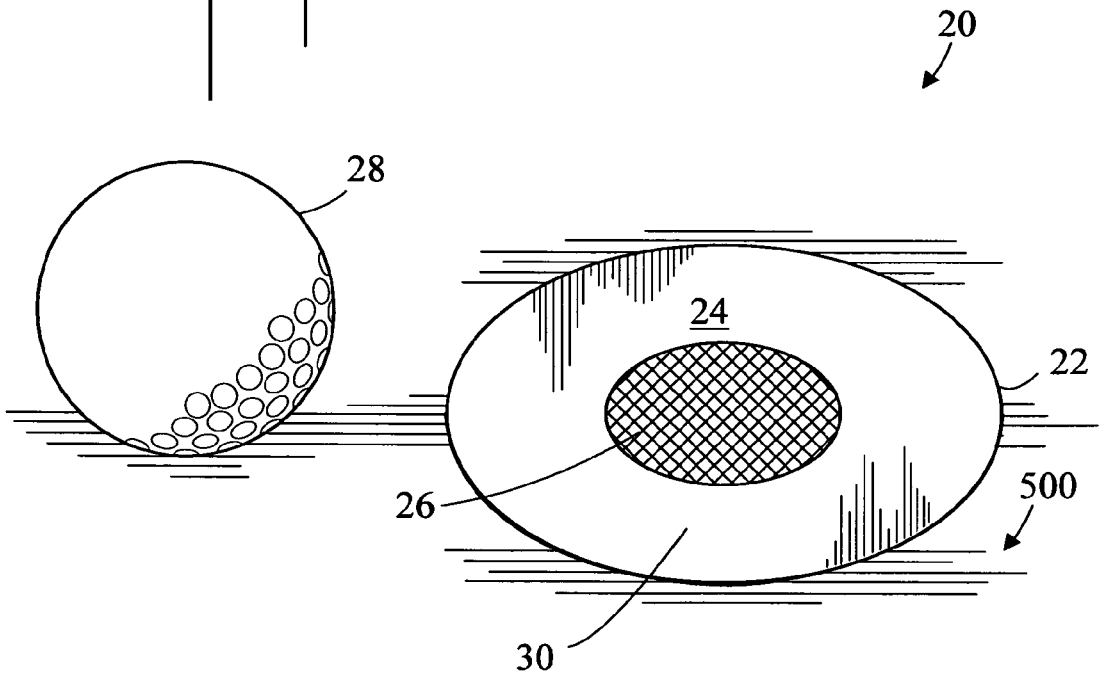
FIG. 1 is a perspective view of a system for playing golf.
Figure 2:
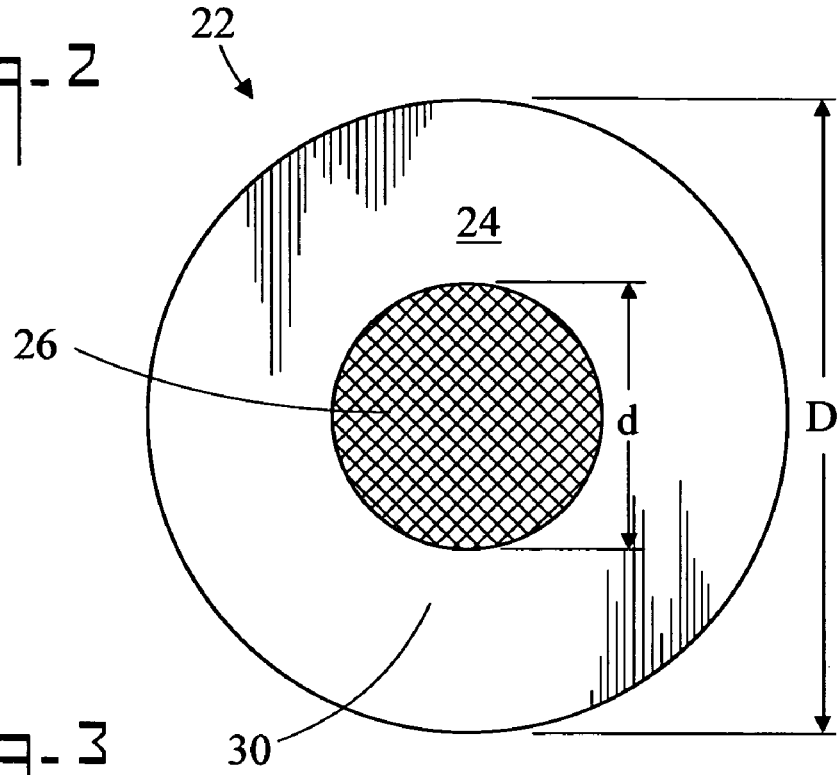
FIG. 2 is a top plan view of a member having a surface.
Figure 3:
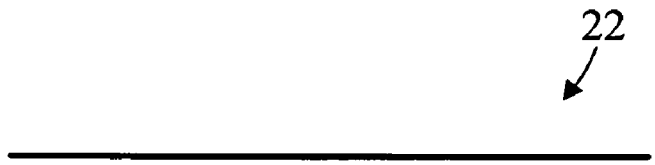
FIG. 3 is a side elevation view of the member.
Figure 4:
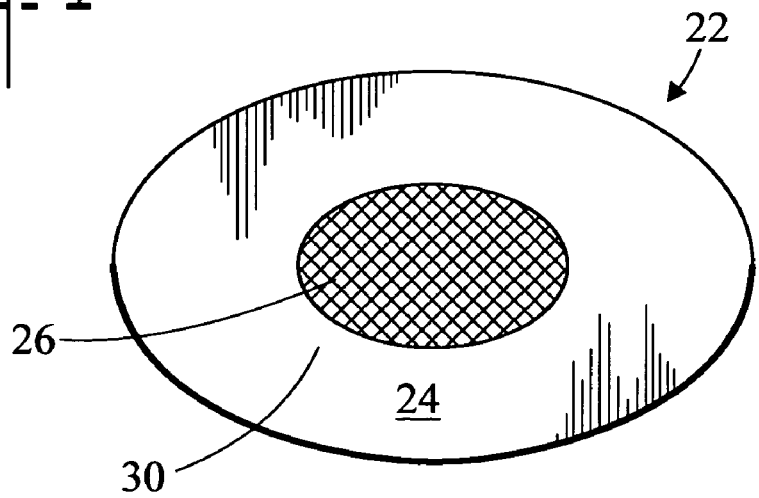
FIG. 4 is a perspective view of the member.

Referring initially to FIG. 1, there is illustrated a system for a player to play golf, generally designated as 20. System 20 includes a member 22 which is also illustrated in FIGS. 2-4. Member 22 has a surface 24. A colored area 26 is disposed on surface 24 of member 22. In an embodiment, colored area 26 is yellow which when stared at will produce a violet afterimage. In another embodiment, the yellow color has a wavelength of about 550 nanometers (greenish yellow); and the violet afterimage will have a wavelength of about 400 nanometers. In another embodiment, colored area 26 is a fluorescent yellow such as is available in a marking pen (highlighter) from a stationary store. System 20 further includes a golf ball 28 which is positionable so that the player can view both golf ball 28 and colored area 26 of member 22. In the shown embodiment, both member 22 and golf ball 28 are placed on a support surface 500 (such as grass, soil, turf, artificial turf; a pad, a mat, or the like).

In the shown embodiment, member 22 is a disc shaped sheet made from paper, cardboard or the like, and has a diameter D of about three inches. In the shown embodiment colored area 26 is circular and has a diameter d of about 1.25 inches, but could be other shapes or sizes. Colored area 26 is surrounded by a donut-shaped second area 30 which is also disposed on surface 24 of member 22. In an embodiment, second area 30 is white.

Figure 5:
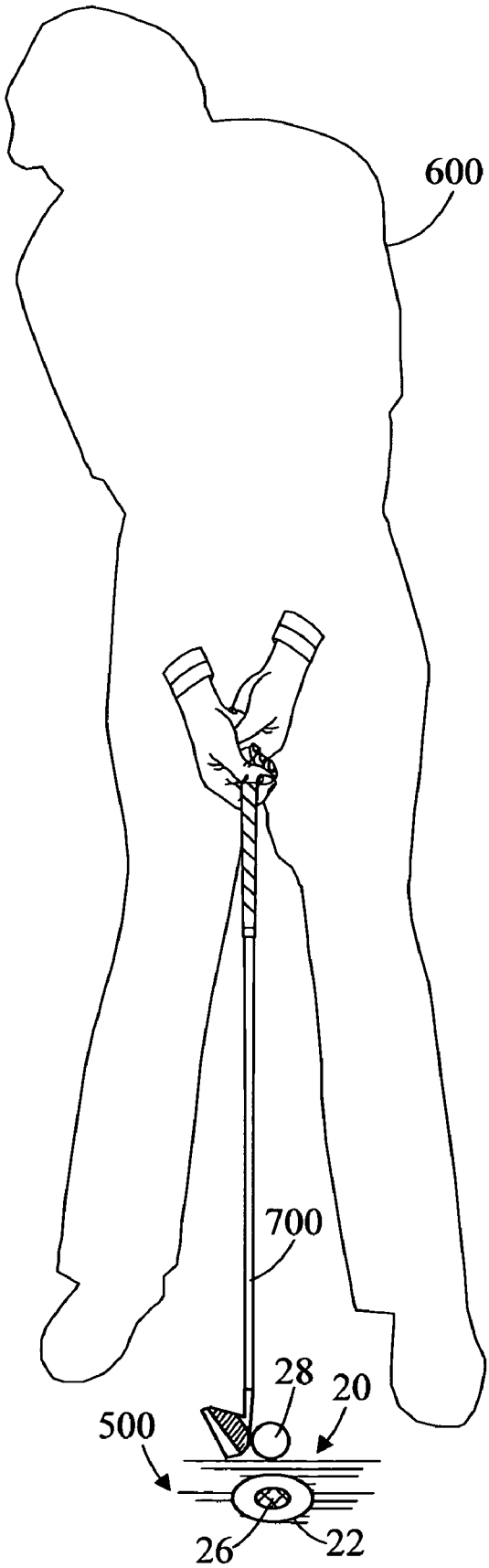
FIG. 5 is a reduced front elevation view of a player using the system.

FIG. 5 is a reduced front elevation view of a player 600 using system 20. Member 22 and golf ball 28 have been placed upon support surface 500. Player 600 stares at colored area 26 for a few seconds (e.g. 3-5 seconds) and then uses golf club 700 to hit golf ball 28. (also refer to the following method of use).

In terms of using embodiment 20, a method for a player 600 to play golf includes (refer to FIGS. 1-5 and the associated discussions)

(a) providing a support surface 500;

(b) providing a golf club 700;

(c) providing a system 20 for playing golf including;

a member 22 having a surface 24;

a colored area 26 disposed on surface 24 of member 22, colored area 26 being yellow;

a golf ball 28 which is positionable upon support surface 500;

(d) placing golf ball 28 and member 22 upon support surface 500 so that player 600 can view both golf ball 28 and colored area 26;

(e) player 600 staring at colored area 26 for a few seconds;

(f) after step (e), player 600 closing his or her eyes and seeing a violet afterimage; and, (g) player 600 opening his or her eyes and using golf club 700 to hit golf ball 28.

The method further including:

in step (c) member 22 being disk shaped.

The method further including:

in step (c), said yellow having a wavelength of about 550 nanometers; and, in step (f), said violet afterimage having a wavelength of about 400 nanometers.

The method further including:

in step (c), colored area 26 being a fluorescent yellow.

The method further including:

prior to step (f), player 600 conditioning his/her vision by staring at said colored area for a short period of time every day for a few weeks (see discussion below). It is noted that the player can use a member 22 other than the one used during a round of golf to effect the visual conditioning.

Visual Conditioning:

To prepare for using the method and system, the player practices daily, for about 5 minutes, for 3 to 4 weeks, enabling the player to begin to see a violet (about 400 nanometer) afterimage. After a short amount of visual conditioning (perhaps the first use), the player, with his/her eyes closed, will see a violet afterimage. As the player continues to have his/her eyes closed and see the violet afterimage, the player's brain waves begin to slow down. Approximately ⅔'s of the brain is used for visual processing. Focusing on the violet 400 nanometer afterimage causes the brain to synchronize between 3 Hz and 12 Hz—alpha frequency. Between 3 and 4 weeks of use, for a few minutes per day, the player will experience the alpha state—a very blissful, relaxed feeling.

After the above visual conditioning, before a golf shot the player places member 22 colored area 26 up on the ground near their golf ball. If teeing off, the player places the tee through the tee hole in the member. The player then stares at the colored area 26, takes a deep breath, closes his/her eyes, sees the violet afterimage, exhales, open his/her eyes and swings the golf club at the golf ball. This process takes just a few seconds.

Figure 6:
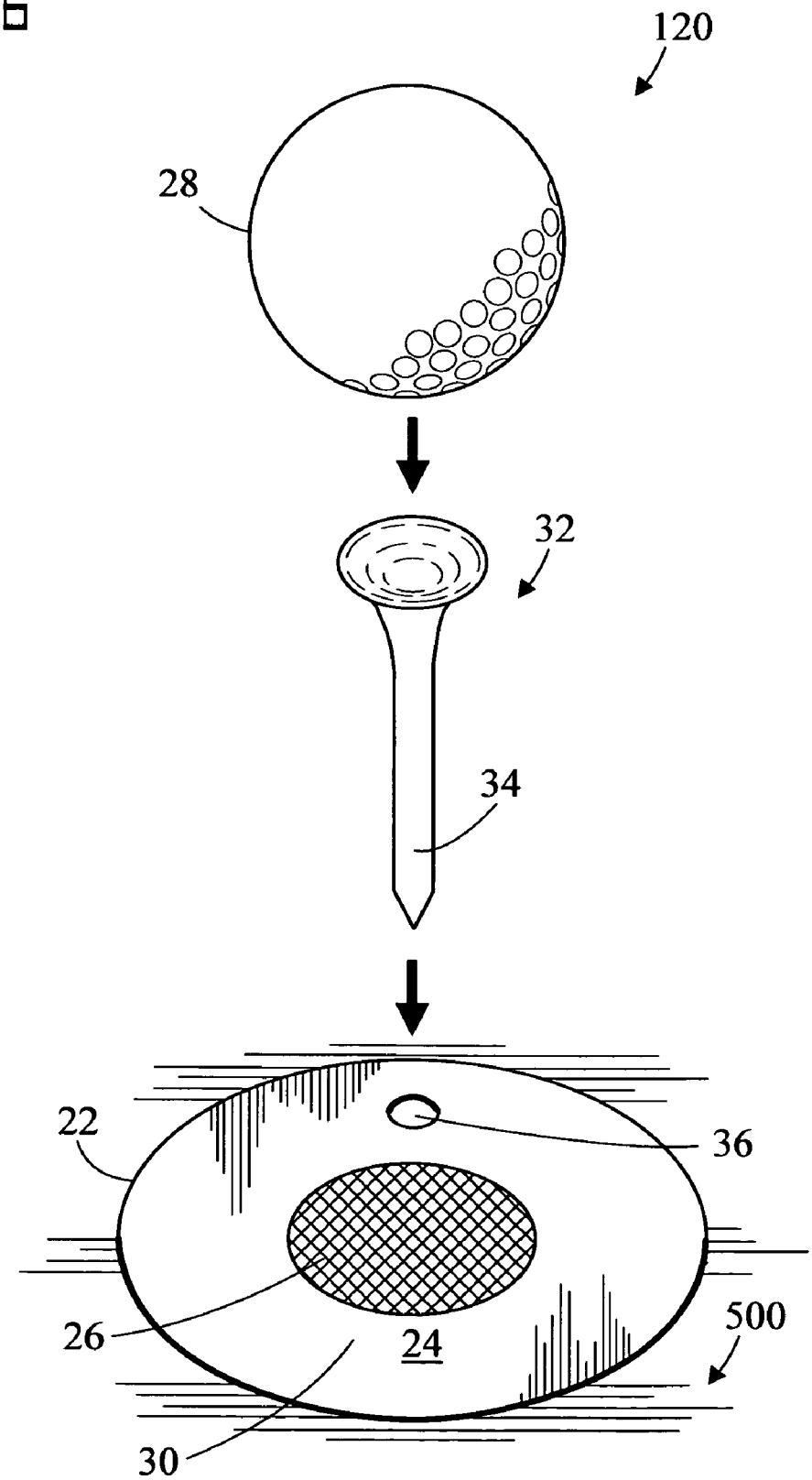
FIG. 6 is an exploded perspective view of a second embodiment of the system.
Figure 7:
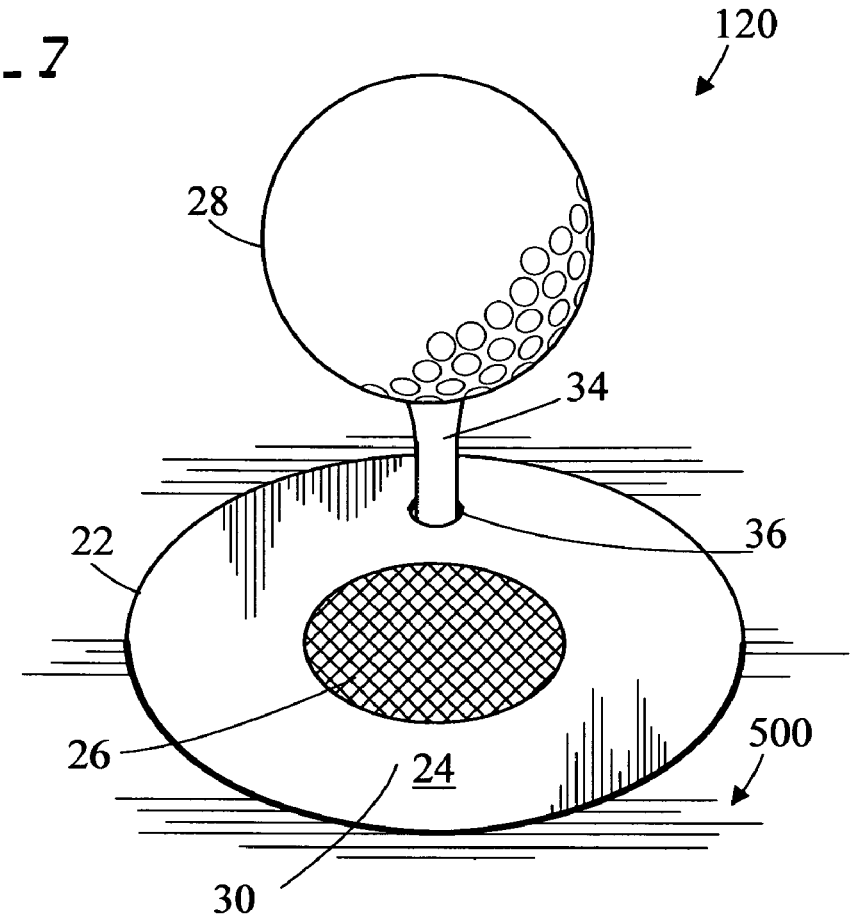
FIG. 7 is a perspective view of the second embodiment.
Figure 8:
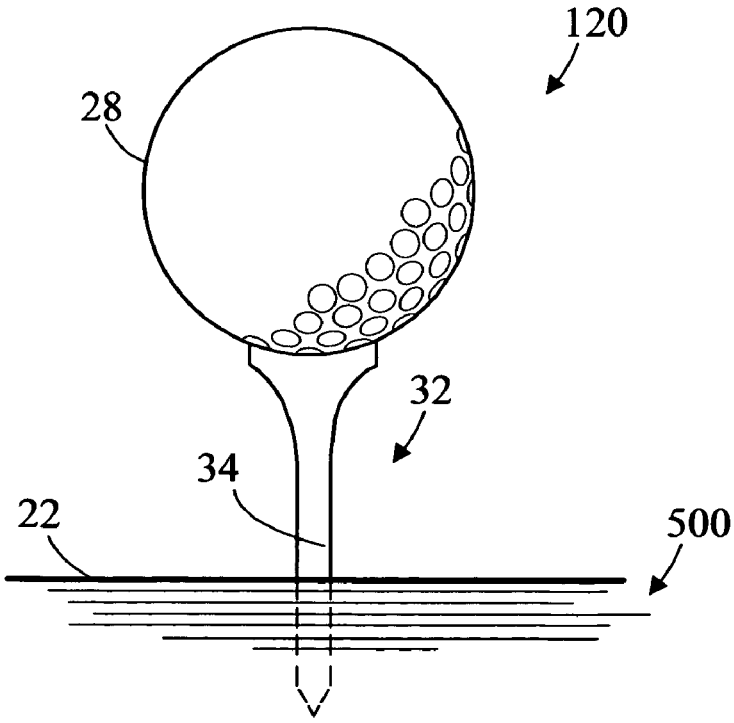
FIG. 8 is a side elevation view of the second embodiment.

FIGS. 6-8 are exploded perspective, perspective, and side elevation views respectively of a second embodiment, generally designated as 120. Embodiment 120 is similar to embodiment 20 and includes member 22 having surface 24, colored area 26, golf ball 28, and second area 30. Embodiment further includes a golf tee 32 which has a shank 34, and a hole 36 disposed in second area 30 of member 22. Hole 36 is shaped and dimensioned to closely receive shank 34 of golf tee 32. Shank 34 of golf tee 32 is placed through hole 36 of member 22, and shank 34 is inserted into support surface 500.

Figure 9:
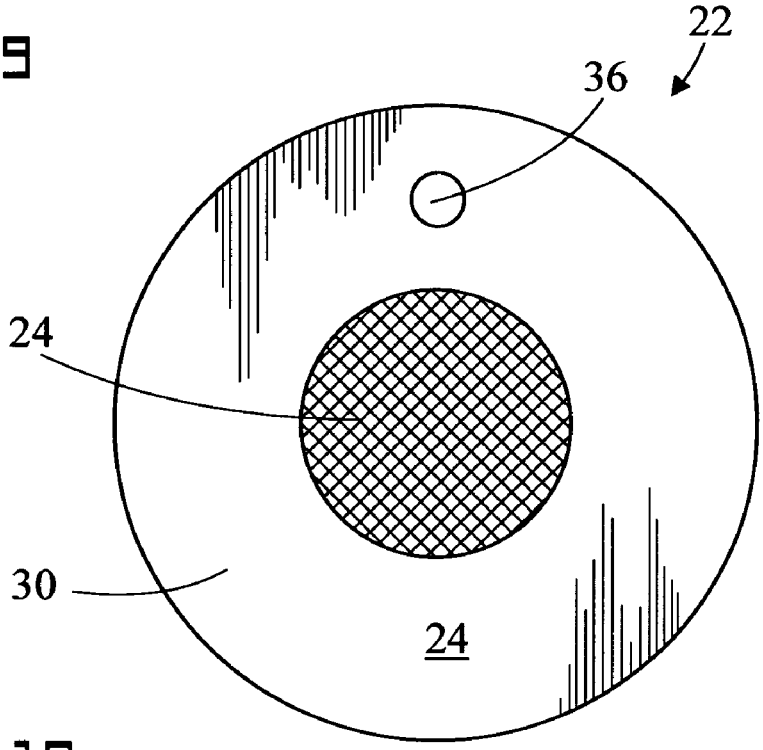
FIG. 9 is a top plan view a second embodiment of the member.
Figure 10:
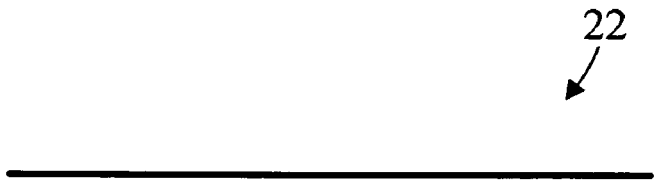
FIG. 10 is a side elevation view of the second embodiment member.
Figure 11:
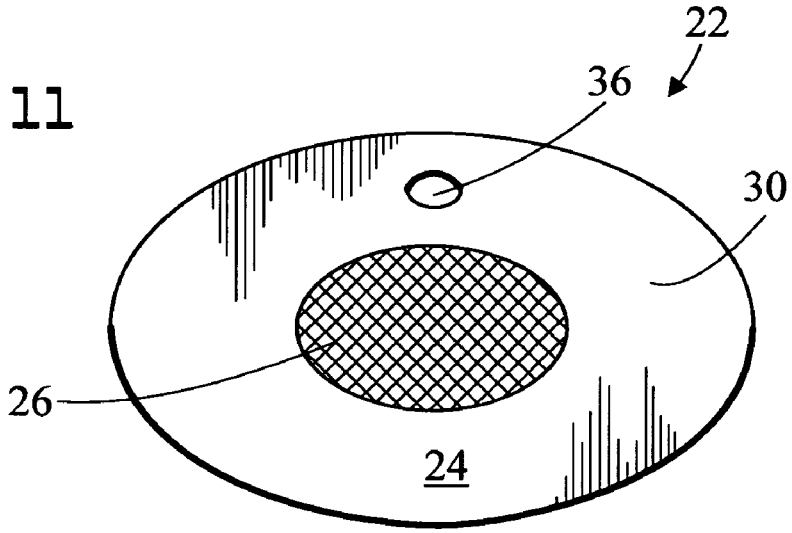
FIG. 11 is a perspective view of the second embodiment member.

FIGS. 9-11 are top plan, side elevation, and perspective views respectively of member 22, surface 24, colored area 26, second area 30, and hole 36.

Figure 12:
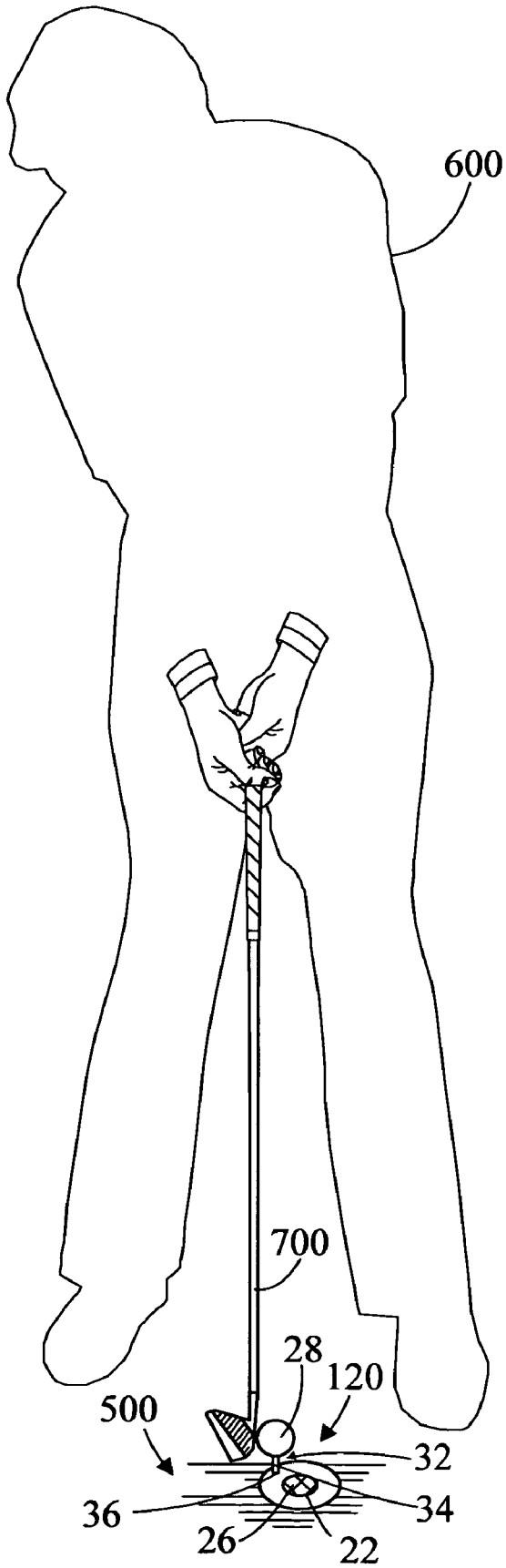
FIG. 12 is a reduced front elevation view of a player using the second embodiment of the system.

FIG. 12 is a reduced front elevation view of player 600 using second embodiment 120. Member 22 has been placed upon support surface 500, shank 34 of golf tee 32 is placed through hole 36 in member 22, and golf ball 28 is placed upon golf tee 32. Player 600 stares at colored area 26 for a few seconds (e.g. 3-5 seconds) and then uses golf club 700 to hit golf ball 28. (also refer to the following method of use). Using embodiment 120 is similar to that of embodiment 20 discussed above, with the exception that player 600 places shank 34 of golf tee 32 through hole 36 in member 22, then inserts shank 34 into support surface 500, and then places golf ball 28 on golf tee 32. Moreover, it is noted that in step (d) the term "placing golf ball 28 upon support surface 500" is intended to include indirect placement upon intervening golf tee 32, which is inserted into support surface 500.

Figure 13:
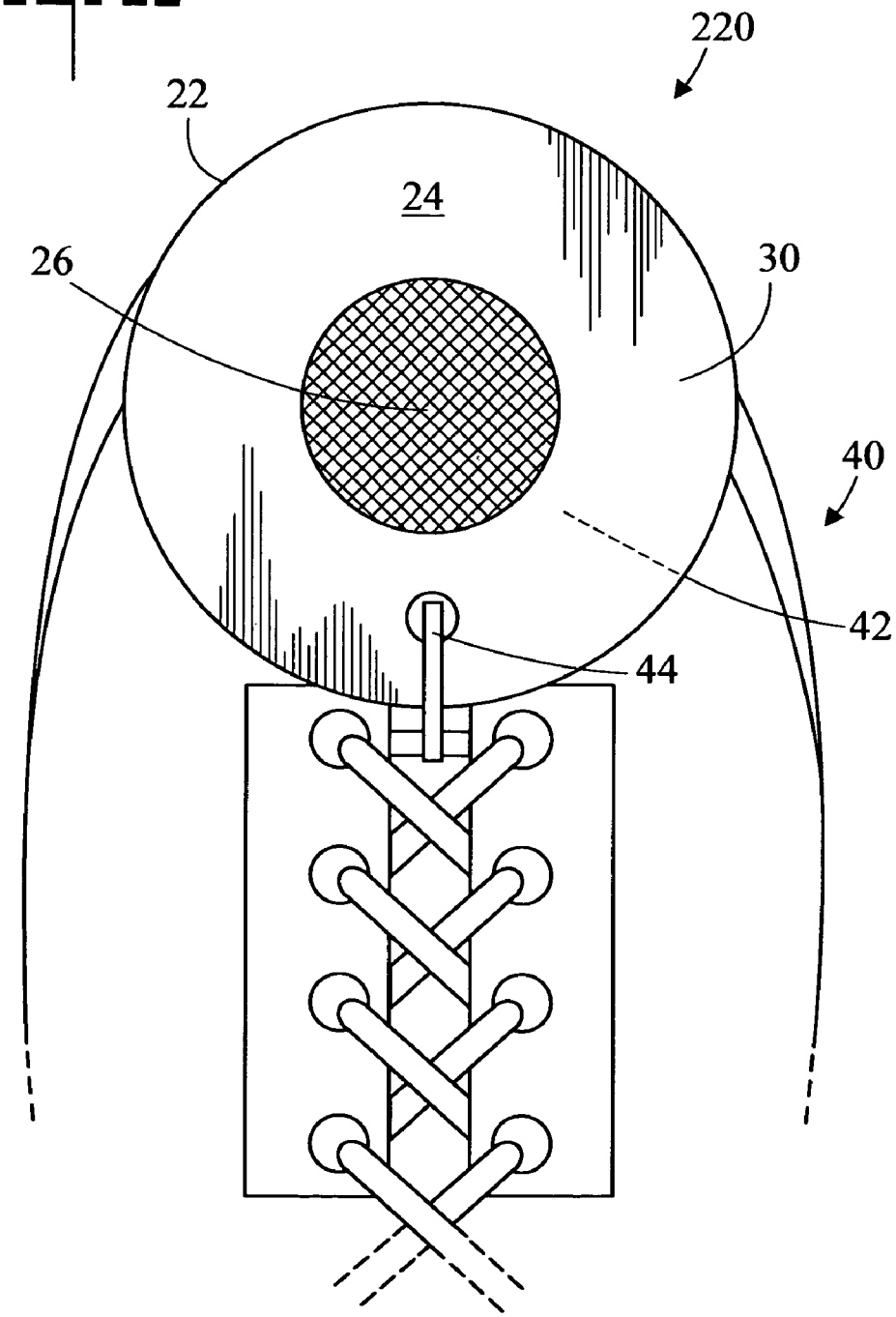
FIG. 13 is a top plan view of a third embodiment of the system.

FIG. 13 is a top plan view of a third embodiment, generally designated as 220. As with embodiments 20 and 120, embodiment 220 includes member 22 having surface 24, and colored area 26 which will produce a violet afterimage of about 400 nanometers, and second area 30. The system of embodiment 220 also includes an article of wearing apparel 40 which is worn by player 600 (also refer to FIGS. 14 and 15). Member 22 is disposable on article of wearing apparel 40 so that colored area 26 is visible to player 600. In the shown embodiment, article of wearing apparel 40 is shoe which has a vamp 42 (upper front portion of the shoe). It may be appreciated however that other wearing apparel 40 such as shirts, pants, hats, gloves, and the like could also be used (refer also to FIG. 14). Member 22 is disposable on the shoe 40 so that member 22 resides surface up on vamp 42 of shoe 40. System 220 further includes a connector 44 for connecting member 22 to article of wearing apparel 40. In the shown embodiment connector 44 is a tie which connects member 22 to article of wearing apparel 40 (to the laces of the shoe). It may be appreciated that other connectors such as clips, clamps, straps, adhesive, hook and loop fasteners, or the like could also be employed to connect member 22 to article of wearing apparel 40.

Figure 14:
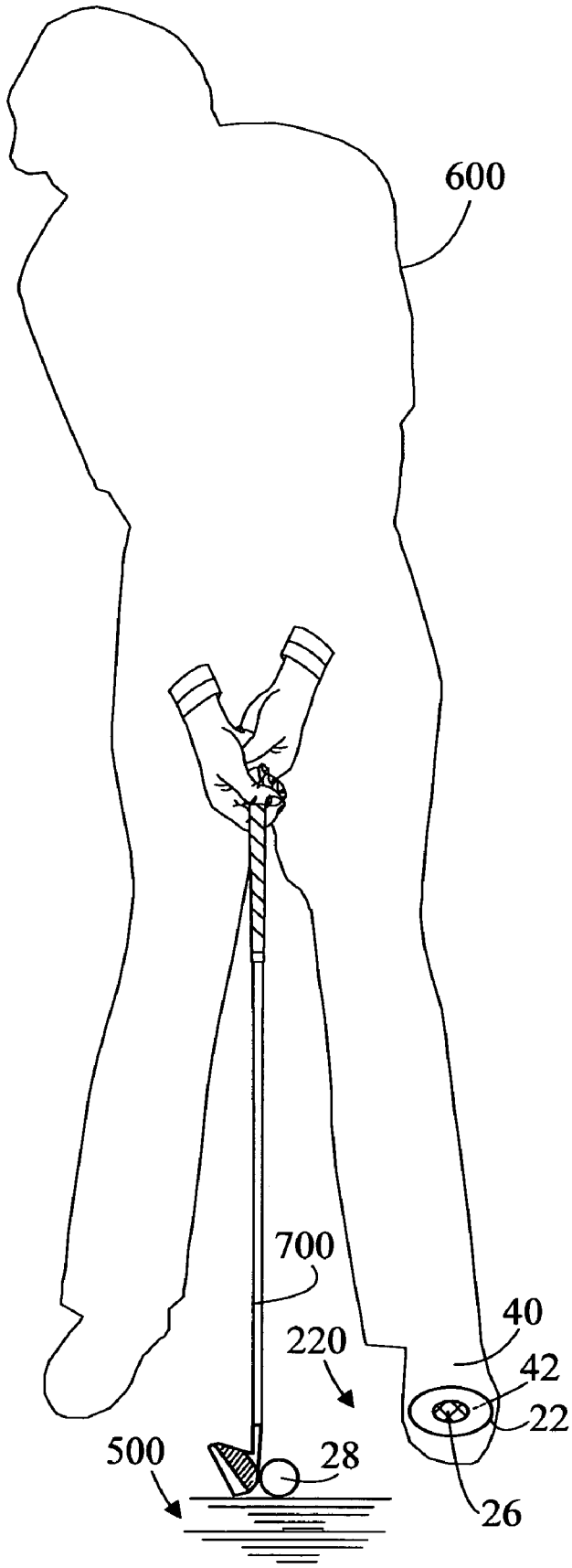
FIG. 14 is a reduced front elevation view of a player using the third embodiment of the system; and, FIG. 15 is a reduced front elevation view of a player using another version of the third embodiment.
Figure 15:
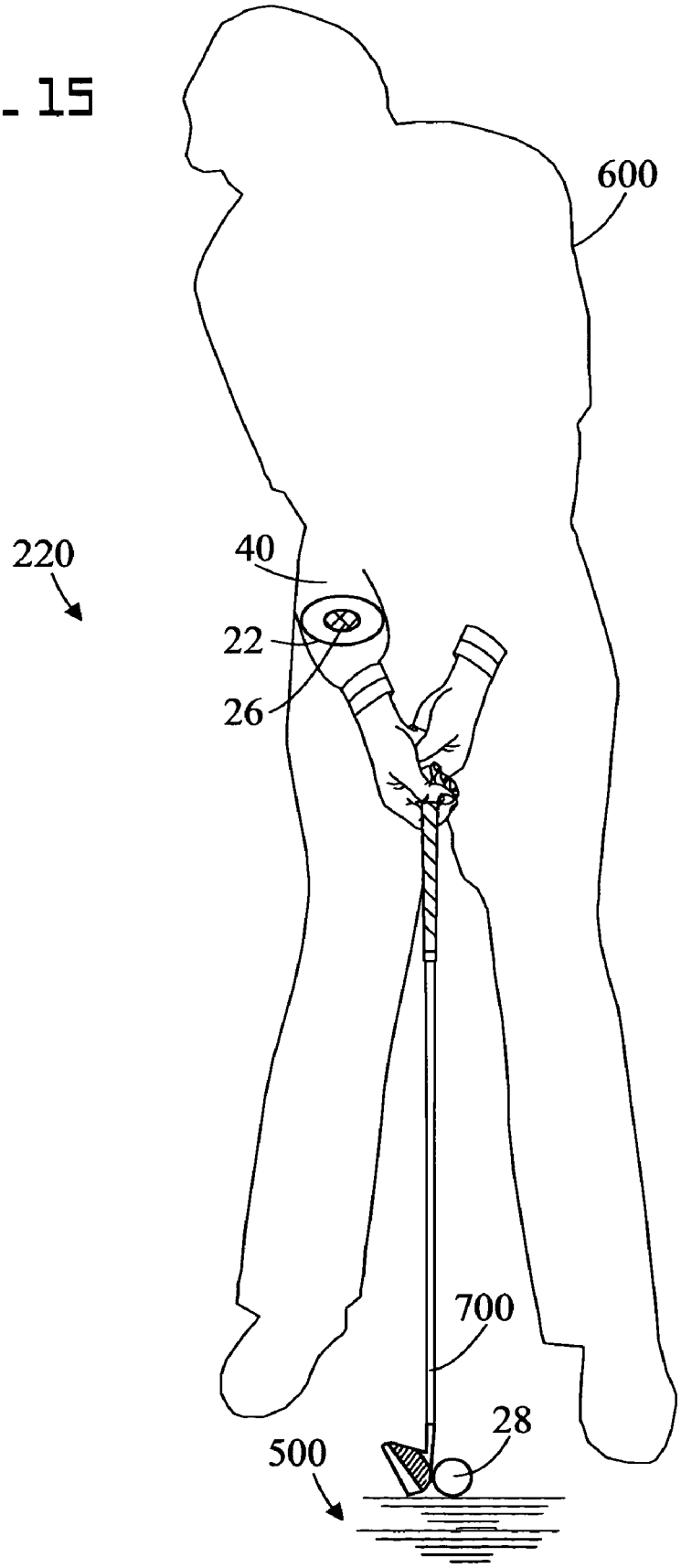

FIG. 14 is a reduced front elevation view of a player 600 using third embodiment 220, and FIG. 15 is a reduced front elevation view of a player using another version of embodiment 220. Shown are member 22, colored area 26, golf ball 28, article of wearing apparel 40, support surface 500, player 600, and golf club 700. In FIG. 14, member 22 is disposed on the shoe of player 600, and in FIG. 15, member 22 is disposed on the shirt sleeve of player 600. In both cases member 22 is positioned so that colored area 26 can be viewed by player 600. It may be appreciated that connecting member 22 to article of wearing apparel 40 includes disposing member 22 directly onto article of wearing apparel 40 such as by printing, painting, silkscreeing, or the like.

In terms of using embodiment 220, a method for a player 600 to play golf includes (refer to FIGS. 13-15 and the associated discussions)

(a) providing a support surface 500;

(b) providing a golf club; 700

(c) providing a system 220 for playing golf including;

a member 22 having a surface 24;

a colored area 26 disposed on surface 24 of member 22, colored area 26 being yellow;

a golf ball 32 which is positionable upon support surface 500;

an article of wearing apparel 40 worn by player 600;

(d) causing member 22 to be disposed on article of wearing apparel 40 so that colored area 26 is visible to player 600;

(e) placing golf ball 32 upon support surface 500;

(f) player 600 staring at colored area 26 for a few seconds;

(g) after step (f), player 600 closing his or her eyes and seeing a violet afterimage; and, (h) player 600 opening his or her eyes and using golf club 700 to hit golf ball 32.

The method further including:

in step (c), providing a connector for connecting member 22 to article of wearing apparel 40 in step (d).

The method further including:

prior to step (f), player 600 conditioning his/her vision by staring at colored area 26 for a short period of time every day for a few weeks.

The method further including:

in step (c), article of wearing apparel 40 being a shoe having a vamp 42; and, in step (d), connecting member 22 to vamp 42 of shoe 40 so that surface 24 can be viewed by player 600.

The possible embodiments of the method and system described herein are exemplary and numerous modifications, combinations, variations, and rearrangements can be readily envisioned to achieve an equivalent result, all of which are intended to be embraced within the scope of the appended claims. Further, nothing in the above-provided discussions of the method and system should be construed as limiting the invention to a particular embodiment or combination of embodiments. The scope of the invention is best defined by the appended claims.

I claim:

1. A system for a player to play golf, comprising:

a member having a surface;

a colored area disposed on said surface of said member, said colored area being yellow;

a golf ball which is positionable so that the player can view both said golf ball and said colored area;

a second area disposed on said surface of said member, said second area being white and completely surrounding said colored area;

a hole disposed in said second area;

a golf tee having a shank; and, said hole shaped and dimensioned to receive said shank of said golf tee.

2. The system according to 1, further including:

said member being disk shaped and having a perimeter; and, said second area disposed at said perimeter.

3. The system according to claim 1, further including:

said yellow having a wavelength of about 550 nanometers which produces a violet afterimage having a wavelength of about 400 nanometers.

4. The system according to claim 1, further including:

said colored area being a fluorescent yellow.

5. The system according to claim 1, further including:

said member being disk shaped;

said yellow having a wavelength of about 550 nanometers which produces a violet afterimage having a wavelength of about 400 nanometers; and, said colored area being a fluorescent yellow.

6. A device for a player to play golf, the device cooperating with a golf tee having a shank, the device comprising:

a member having a surface;

a colored area disposed on said surface of said member, said colored area being yellow, said yellow having a wavelength of about 550 nanometers which produces a violet afterimage having a wavelength of about 400 nanometers;

a second area disposed on said surface of said member, said second area being white and completely surrounding said colored area;

a hole disposed in said second area; and, said hole shaped and dimensioned to receive the shank of the golf tee.

7. A device for a player to play golf, the device cooperating with a golf tee having a shank, the device comprising:

a member having a surface;

a colored area disposed on said surface of said member, said colored area being yellow, said yellow having a wavelength of about 550 nanometers which produces a violet afterimage having a wavelength of about 400 nanometers;

a second area disposed on said surface of said member, said second area being white and completely surrounding said colored area;

said member being circular;

said colored area being circular;

a hole disposed in said second area;

said hole shaped and dimensioned to receive the shank of the golf tee; and, said colored area and said second area containing no indicia.

8. A device for a player to play golf, the device cooperating with a golf tee having a shank, the device comprising:

a circular member having a surface;

a colored area disposed on said surface of said member, said colored area being circular and yellow;

a second area disposed on said surface of said member, said second area being white and completely surrounding said colored area, said second area being donut shaped;

a hole disposed in said second area; and, said hole shaped and dimensioned to receive the shank of the golf tee.

* * * * *